US005885349A

United States Patent [19]

Giallourakis

[11] Patent Number: 5,885,349

[45] Date of Patent: Mar. 23, 1999

[54] PAINT PAD

[76] Inventor: Michael A. Giallourakis, 535 Midway La., Tarpon Springs, Fla. 34689

[21] Appl. No.: 803,924

[22] Filed: Feb. 21, 1997

Related U.S. Application Data

[60] Provisional application No. 60/012,546, Feb. 29, 1996.

[51] Int. Cl. [6] ..... B05C 1/00

[52] U.S. Cl. ..... 118/264; 118/265; 15/244.1; 15/210.1; 15/118

[58] Field of Search ..... 118/264, 265; 15/244.1, 118, 210.1; 427/429

[56] References Cited

U.S. PATENT DOCUMENTS

| | | | |
|---|---|---|---|
| 3,083,392 | 4/1963 | Sewell | 15/244.1 |
| 3,204,278 | 9/1965 | Lambros | 15/244.1 |
| 4,996,735 | 3/1991 | Blankenship | 15/210.1 |
| 5,626,672 | 5/1997 | Rossetti | 118/264 |
| 5,678,277 | 10/1997 | Sorenson | 15/210.1 |

*Primary Examiner*—Laura Edwards
*Attorney, Agent, or Firm*—James Creighton Wray; Meera P. Narasimhan

[57] ABSTRACT

A paint pad allows a user to produce a unique finish to a surface without having to wear gloves. The pad includes a base having an upper surface and a lower surface. A painting medium, such as a sponge, chamois leather, chenille, loofah, synthetic foam or cloth, is connected to the lower surface of the base. A handle extends from the upper surface of the base. Preferably, the handle and base form a one piece structure made of polystyrene foam or a lightweight plastic. The handle and base have shapes and thicknesses for maximizing user control of over the painting medium and for preventing the user's hand from contacting the painting medium and the surface being painted. In one preferred embodiment, the base and handle are both circular, with the handle extending from a center of the base and with the diameter of the base being greater than the diameter of the handle. In other preferred embodiments, the handle and base are both generally rectangular, with the width of the handle being less than the width of the base. The present paint pad provides for even paint distribution, is long lasting and is economical. In preferred embodiments, the paint pad is packaged in a single paper or paperboard sheet having a front panel, a back panel and a middle panel connecting bottom edges of the front and back panels. The back panel includes a cutout region for receiving the handle of the paint pad.

6 Claims, 3 Drawing Sheets

PAINT PAD

BACKGROUND OF THE INVENTION

This application claims the benefit of U.S. Provisional Application No. 60/012,546, filed Feb. 29, 1996.

The present invention relates to decorating equipment for painting large and small areas.

Ragging and sponging are painting techniques for creating textured surfaces. Chamois, sponges and other mediums are used to apply paint in such a fashion that the paint is not uniformly applied onto the surface. Altering the pressure exerted and the direction in which the paint is applied results in a infinite variety of possible patterns. Nearly uniform impressions may be formed on the painted surface. Similar results are achieved by first painting a surface in the normal fashion using a brush or a roller and then using the chamois or other medium to disturb the uniform surface.

Handheld sponges and chamois are typically used to paint walls, ceilings, floors, furniture, table tops, pipes, trim, mirrors, glass, canvas, paper and objects of art. A major drawback associated with existing handheld implements is that they are difficult to grip. As a result, users experience a lack control. That lack of control restricts the user's ability to create a desirable uniform impression. Needs exist for handheld tools which increase user control throughout the painting process.

Existing handheld sponges and chamois are messy. Users' hands are in constant contact with the paint. While gloves may keep paint from contacting the user's hands, unintentional smudging and glove prints litter the painted surface and detract from the quality of the painting. That problem is exacerbated in situations where users repeatably change the color of the paint being used. Those problems are not eliminated when users wear gloves. Needs exist for handheld sponges and similar implements which keep users' hands away from the paint-carrying sponge or cloth during application and cleaning.

SUMMARY OF THE INVENTION

The present invention is a handheld painting pad that provides for easy, controlled painting in small or large areas.

The present paint pad allows a user to produce a unique finish to a surface without having to wear gloves. The pad includes a backing base having an upper surface and a lower surface. A painting medium, such as a sponge, chamois leather, chenille, loofah, synthetic foam or cloth, is connected to the lower surface of the base. A handle extends from the upper surface of the base. Preferably, the handle and base form a one piece structure made of polystyrene foam or a lightweight plastic. The handle and base have shapes and thicknesses for maximizing user control of over the painting medium and for preventing the user's hand from contacting the painting medium and the surface being painted. The present paint pad provides for even paint distribution, is long lasting and is economical.

The surfaces of the sponge are typically but not necessarily flat. Using a cross-section of a sponge is less expensive and equally as effective as using an entire sponge. The cross-sectional shape of the natural sponge can vary widely. The shape of the backing base preferably corresponds to the shape of the sponge cross-section.

In a preferred embodiment, the handle is made of polystyrene and is attached to a natural sponge using a water-insoluble adhesive. Several substitutes for the natural sponge are contemplated including chamois leather or chenille for ragging, loofah for texturing, synthetic foam having a particular pattern for variations in texturing, and cloth.

The handle of the paint pad provides for increased user control during the paint application. No gloves are needed, as users' hands do not contact the painting medium. The handle allows the user to apply paint in a uniform manner without distorting the painting with unintentional smudges, smears and finger prints. The handle further allows the sponge to be dipped into the coating material without undue mess. Once painting is complete, the sponge or other painting medium is easily washed with water without requiring the user to touch the sponge.

The paint pad is packaged in a single paper or paperboard sheet having a front panel, a back panel and a middle panel connecting bottom edges of the front and back panels. The back panel includes a cutout region for receiving the handle of the paint pad.

A paint pad includes a base having an upper surface and a lower surface. A paint-applying medium is connected to the lower surface of the base. A handle extends from the upper surface of the base. In preferred embodiments, the base and the handle are a one-piece structure made of polystyrene foam or a lightweight plastic.

In preferred embodiments, the width of the base is greater than the width of the handle. In one preferred embodiment, the base and handle are both generally circular, with the diameter of the base being greater than the diameter of the handle. In another preferred embodiment, the base and handle are generally rectangular, with the thickness of the handle being greater than the thickness to the base.

The paint-applying medium is preferably a sponge, such as a natural sponge, chamois leather, chenille, loofah, synthetic foam, a rag, cloth or combinations thereof. In one preferred embodiment, the paint-applying medium includes a sponge having a central opening and chamois leather bunched in the opening.

In preferred embodiments, the paint-applying medium is a water-insoluble and paint-insoluble adhesive.

Packaging for the paint pad preferably includes a sheet having a front panel, a back panel and a bottom panel extending between and connecting the front and back panels. The back panel has a cutout portion for receiving a handle of the paint pad. Upper regions of the front and back panels are connectable for closing the package. The front panel preferably includes a top part having an aperture, a middle part and a lower part connected at one end to the middle part and at an opposite end to the bottom panel. The lower part has side edges sloping inward and downward from the middle part. The top part is connected to the upper region of the back panel. The middle part extends at generally right angles from the top and lower parts.

A method for texturing painted surfaces includes the step of providing a painting pad having a base, a painting medium connected to a lower surface of the base and a handle extending from an upper surface of the base. A user grasps the handle with a hand such that fingers rest on the handle and the upper surface of the base. The painting medium is then dipped into the paint, with the handle and user's hand safely away from the paint. Once excess paint is removed, the user may transfer paint from the painting medium to the surface to be painted. During application, the user may continuously alter hand positions to avoid creating a set pattern. A user grasps the handle by placing a palm of the hand along a top surface of the handle, resting a thumb of the hand along a side wall of the handle and upper surface of the base, and extending the fingers along the top surface and opposite side wall of the handle and the upper surface of the base.

These and further and other objects and features of the invention are apparent in the disclosure, which includes the above and ongoing written specification, with the drawings.

DETAILED DESCRIPTION OF THE DRAWINGS

Figure 1:
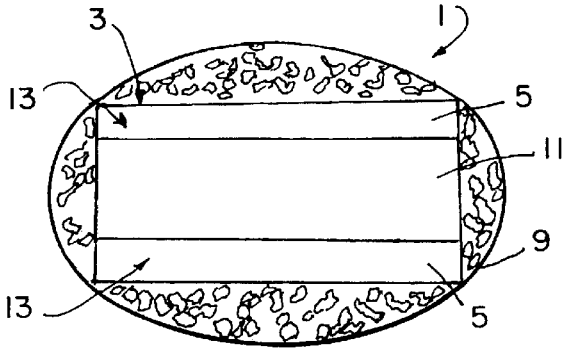
FIG. 1 is a plan view of a paint pad having a generally rectangular base and a generally rectangular handle.
Figure 2:
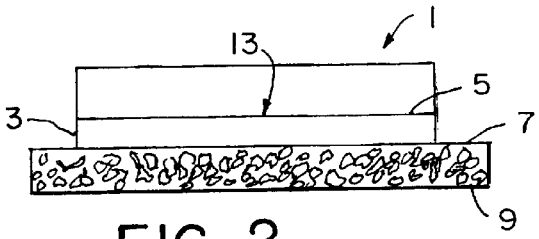
FIG. 2 is a side view of the paint pad of FIG. 1.
Figure 3:
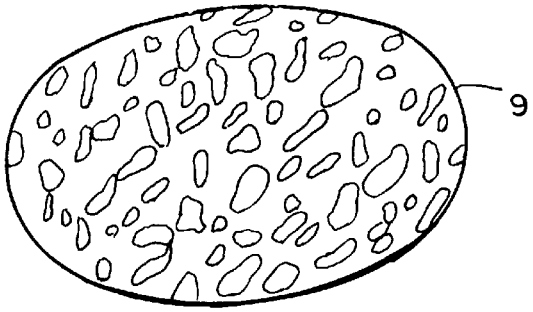
FIG. 3 is a bottom view of the paint pad of FIG. 1.

As shown in FIGS. 1–4, the present invention is a paint pad 1 that eliminates the mess encountered when using handheld natural sponges without requiring the use of plastic gloves. The paint pad 1 includes a backing base 3 having an upper surface 5 and a lower surface 7. A painting medium 9 is connected to the lower surface 7 of the base 3. A handle 11 extends from the upper surface 5 of the base 3. The handle 11, base 3 and painting medium 9 have shapes and dimensions which provide for maximum uniform distribution and increased user control.

Figure 4:
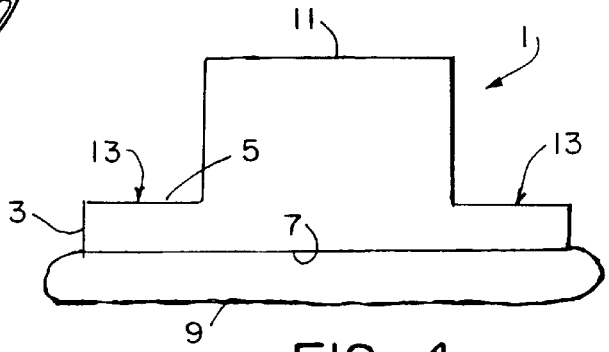
FIG. 4 is a front view of the paint pad of FIG. 1.

As shown in FIGS. 1–4, the paint pad 1 preferably includes a generally rectangular base 3 and a generally rectangular handle 11. The handle 11 preferably extends substantially the entire length of the base 3. The width of the handle 11 is less than the width of the base 3. That provides for ledges 13 along the upper surface 5 of the base 3 on which users rest fingers without risking contact with the painting medium 9. As shown in FIG. 4, the thickness of the handle 11 is greater than the thickness of the base 3. The painting medium 9, which may have any shape and size, preferably extends beyond sides of the base 3 for increasing surface coverage.

Figure 5:
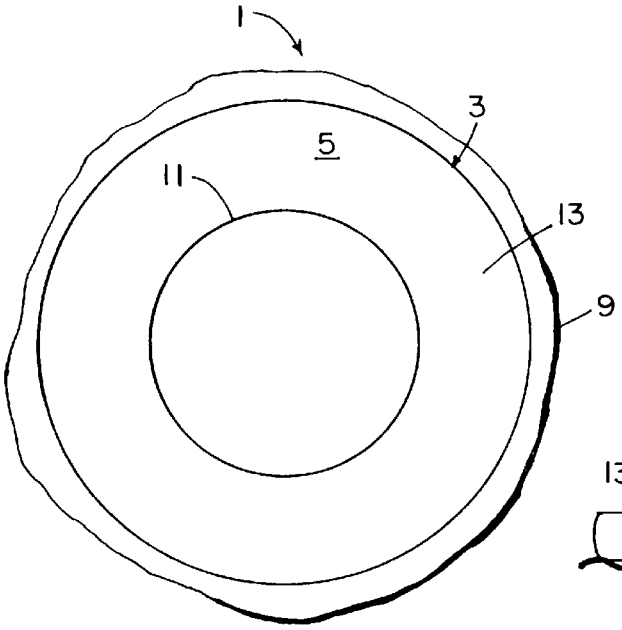
FIG. 5 is a plan view of a paint pad having a generally circular base and a generally circular handle.
Figure 6:
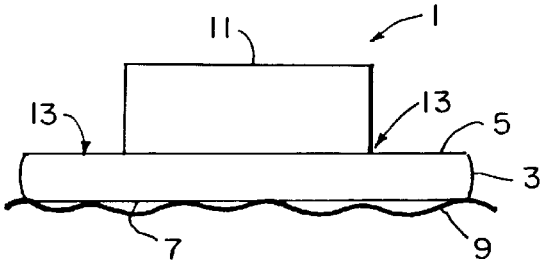
FIG. 6 is a side view of the paint pad of FIG. 5.
Figure 7:
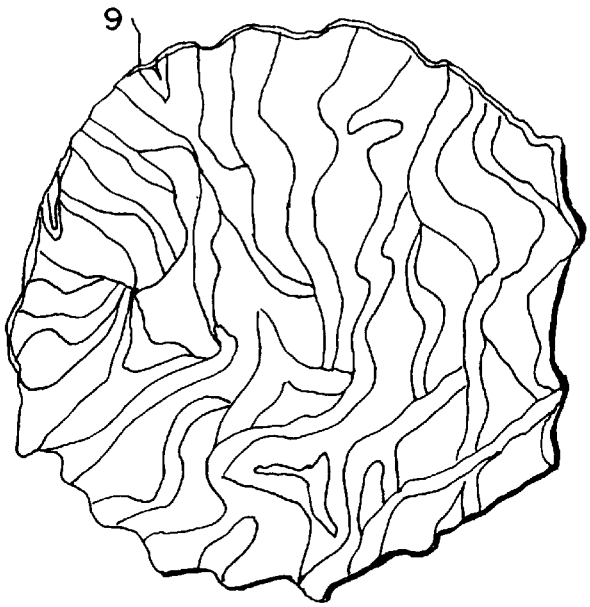
FIG. 7 is a bottom view of the paint pad of FIG. 5.

FIGS. 5–7 show another preferred embodiment of the present invention 1 having a generally circular base 3 and a generally circular handle 11 extending from a central region of the base 3. The diameter of the base 3 is greater than the diameter of the handle 11. Preferably, the diameters of the handle 11 and base 3 are such that the handle 11 may be securely grasped by a user's hand without having the palm, wrist or fingers of the user contact the painting medium 9 or painted surface. In preferred embodiments, the thickness of the handle 11 is substantially the same, or slightly greater than, the thickness of the base 3.

Any suitable sizes and shapes for the base 3, handle 11 and painting medium 9 are possible and considered to be under the scope of the present invention. The base 3 and handle 11 may have the same or different shapes. Possible shapes include, but are not limited to, square, rectangular and circular. It is important, however, that the user be able to hold and control the paint pad 1 without contacting the painting medium 9 or the surface being painted.

In preferred embodiments of the paint pad 1, the handle 11 extends from an upper surface 5 of the base 3. The handle 11 is connectable to the base 3 or integrally formed with the base 3 as a single unit. In preferred embodiments, the base 3 and handle 11 are made of a lightweight material, such as polystyrene foam or plastic.

Figure 8:
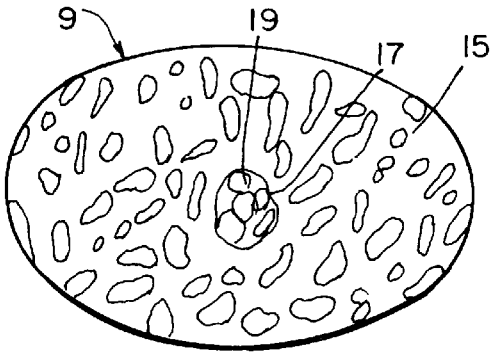
FIG. 8 shows a bottom view of a paint pad having a sponge/rag combination as the painting medium.

The painting medium 9 is connected to the lower surface 7 of the base 3. While any suitable means for connecting the medium 9 to the base 3 is possible, preferred embodiments of the paint pad 1 include a water-soluble adhesive as the connecting means. The painting medium 9 may be any acceptable medium that holds paint and allows for generally even distribution of the paint on a surface. Examples of acceptable painting mediums 9 include, but are not limited to, sponges, including natural sponges, chamois leather, chenille, loofah, synthetic foams, cloths, rags and combinations thereof. FIGS. 1–4 show a preferred embodiment of the paint pad 1 having a natural sponge as the painting medium 9. FIGS. 5–7 show a preferred embodiment of the paint pad 1 having chamois leather as the painting medium 9. FIG. 8 shows a preferred embodiment of the paint pad 1 having a sponge/chamois leather combination as the painting medium 9. The sponge 15 has a central opening 17 into which a bunched-up piece of chamois leather 19 is inserted.

Figure 9:
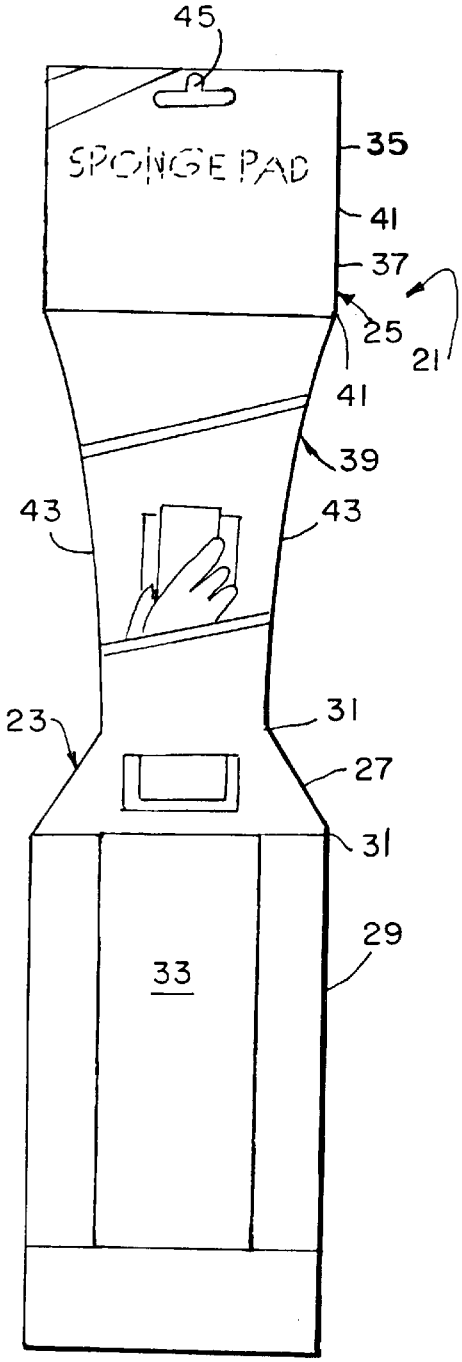
FIG. 9 shows a preferred sheet for packaging the paint pad.
Figure 11:
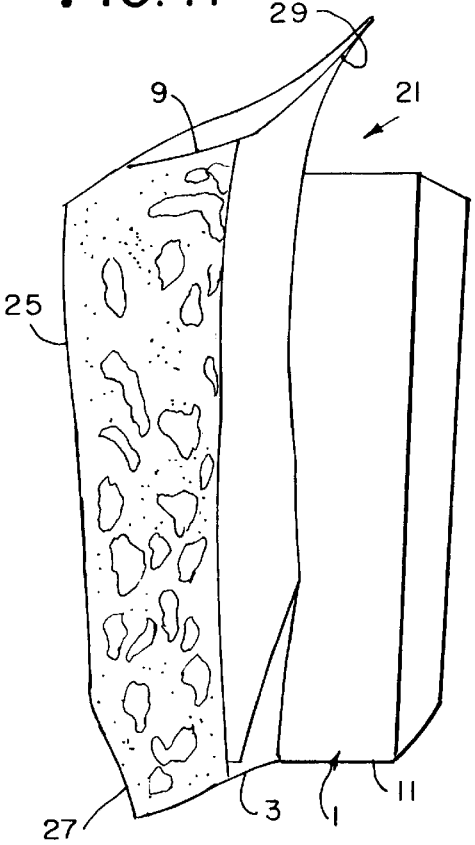
FIG. 11 is a side view of the packaging/paint pad combination of FIG. 10.
Figure 10:
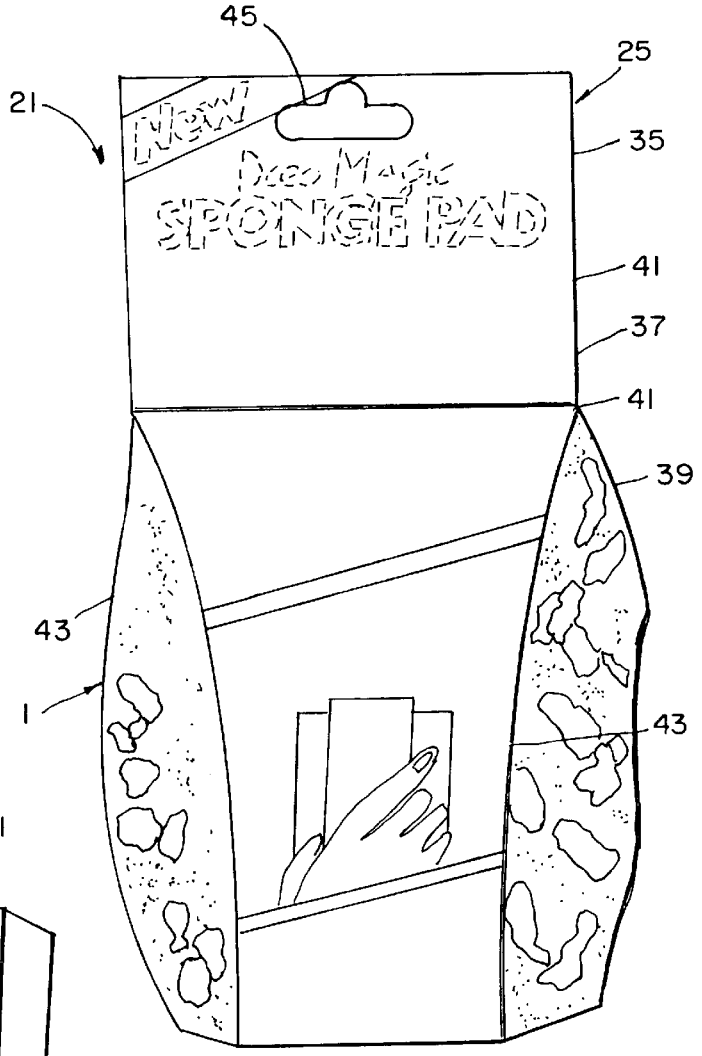
FIG. 10 is a plan view of the packaging of FIG. 9 housing the paint pad.

FIGS. 9–11 show preferred packaging 21 for displaying the present paint pad 1. The packaging 21 is a single sheet 23 of paper, paperboard, plastic or other acceptable material. The sheet 23 includes a front panel 25, a back panel 27 and a bottom panel 29 extending between and connected to lower edges of the front panel 25 and back panel 27. Folds 31 are positioned where the front panel 25 and back panel 27 meet the bottom panel 29. The back panel 27 includes a cutout region 33 for receiving the handle 11 of the paint pad 1. The cutout region 33 has a shape and dimensions corresponding to the shape and dimensions of the handle 11 of the paint pad 1 being packaged. The front panel 25 includes an upper portion 35, a middle portion 37 and a lower portion 39. Fold lines 41 are formed where edges of the middle portion 37 meet the upper portion 35 and the lower portion 39. Side edges 43 of the lower portion 39 preferably slope inward and downward from the middle portion 37 to the bottom panel 29. The upper portion 35 preferably includes an aperture 45 for receiving a hook, display rack or other mounting or display structure. Upper regions of the front panel 25 and back panel 27 are connected for securing the paint pad 1 in the package 21. The handle 11 extends through the cutout region 33. When assembled, the middle portion 37 of the front panel 25 lies in a plane generally parallel to the bottom panel 29, with the back panel 27 and upper 35 and lower 39 portions of the front panel 25 extending at angles generally perpendicular to the bottom panel.

While the invention has been described with reference to specific embodiments, modifications and variations of the invention may be constructed without departing from the scope of the invention, which is defined in the following claims.

I claim:

1. A paint pad apparatus comprising a planar backing base having an upper surface and a lower surface, said backing base including a planar handle extending upwardly from said upper surface, said base and said handle having the same geometric configuration, said backing base having a width substantially greater than said handle to define at least one ledge on said upper surface of said base to protect a user's hand from paint, said handle being of a thickness substantially greater than said base to facilitate gripping by said user's hand, and a planar paint-applying medium including a natural sponge disposed on said lower surface of said base, said paint-applying medium being bonded to said base with a water-insoluble and paint-insoluble adhesive.

2. The apparatus of claim 1, wherein the base and the handle are a one-piece structure.

3. The apparatus of claim 1, wherein the base and handle are made of a material selected from the group consisting of polystyrene foam and plastic.

4. The apparatus of claim 1, wherein the base is generally circular and has a first diameter, wherein the handle is generally circular and has a second diameter, and wherein the first diameter is greater than the second diameter.

5. The apparatus of claim 1, wherein the base and handle are generally rectangular.

6. The apparatus of claim 1, wherein the painting medium further comprises said sponge having a central opening and chamois leather bunched in the opening.

* * * * *